US008109600B2

(12) United States Patent
Okada

(10) Patent No.: US 8,109,600 B2
(45) Date of Patent: Feb. 7, 2012

(54) INKJET RECORDING APPARATUS

(75) Inventor: Goro Okada, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 554 days.

(21) Appl. No.: 12/199,967

(22) Filed: Aug. 28, 2008

(65) Prior Publication Data

US 2009/0058927 A1 Mar. 5, 2009

(30) Foreign Application Priority Data

Aug. 30, 2007 (JP) ..... 2007-223482

(51) Int. Cl.
*B41J 2/165* (2006.01)

(52) U.S. Cl. ..... 347/33; 347/29; 347/36

(58) Field of Classification Search ..... 347/33–37
See application file for complete search history.

(56) References Cited

U.S. PATENT DOCUMENTS 6,932,455 B2 * 8/2005 Monclus et al. ..... 347/22
2005/0035990 A1 * 2/2005 Wotton et al. ..... 347/22
2007/0035569 A1 2/2007 Koto et al.

FOREIGN PATENT DOCUMENTS

JP 2006-069176 A 3/2006

* cited by examiner

*Primary Examiner* — Jason Uhlenhake
(74) *Attorney, Agent, or Firm* — Baker Botts L.L.P.

(57) ABSTRACT

The inkjet recording apparatus includes: a drum which conveys a recording medium, an inkjet head having an ejection surface which faces the outer circumferential surface of the drum, and a cap facing the outer circumferential surface. The inkjet heads are moved by a head-moving mechanism to be in a recording position, wiping position, or a capping position. The cap-moving mechanism moves the cap, in the circumferential direction of the drum along the outer circumferential surface, to: an open position where the cap does not face the ejection surface, or an opposing position in which the cap faces the ejection surface and covers the inkjet head in the capping position.

3 Claims, 7 Drawing Sheets

INKJET RECORDING APPARATUS

CROSS REFERENCE TO RELATED APPLICATION

The present application claims priority from Japanese Patent Application No. 2007-223482, which was filed on Aug. 30, 2007, the disclosure of which is herein incorporated by reference in its entirety.

BACKGROUND OF THE INVENTION

1. Field of the Invention

The present invention relates to an inkjet recording apparatus which ejects ink droplets to record an image on a recording medium.

2. Description of the Related Art

Japanese Unexamined Patent Publication No. 69176/2006 (Tokukai 2006-69176) discloses an inkjet printer including a conveyance mechanism having a drum which rotates to convey a sheet carried on the outer circumferential surface thereof; a plurality of inkjet heads each having an ejection surface, which are aligned in a conveyance direction of the sheet so that the ejection surfaces of the each inkjet heads faces the outer circumferential surface of the drum; and a maintenance unit for performing maintenance of the ejection surface. The maintenance unit has a tray for receiving ink ejected from the inkjet heads. The length of the tray in the axial direction of the drum is the same as that of the drum. The inkjet heads are moveable between a printing position and a non-printing position. The printing position is a position in which the ejection surfaces of the inkjet heads are disposed close to the outer circumferential surface of the drum. The non-printing position is a position in which the ejection surfaces of the inkjet heads are disposed farther apart from the outer circumferential surface of the drum, compared to the printing position. On the other hand, the maintenance unit is moveable in the axial direction of the drum between the retracted position and a maintenance position. The retracted position is a position in which the maintenance unit does not face the ejection surfaces, where as the maintenance position is a position in which the maintenance unit faces the ejection surfaces. During a printing operation, the maintenance unit is in the retracted position and the inkjet heads in the printing position. Further, during a maintenance operation, the inkjet heads move to the non-printing position, after which the maintenance unit moves from the retracted position to the maintenance position.

SUMMARY OF THE INVENTION

The tray of the above mentioned inkjet printer for receiving the ink however is positioned outside the drum in the axial direction of the drum. The inkjet printer therefore is large in the axial direction of the drum.

In view of the above problem the present invention was made, and it is an object of the present invention to provide an inkjet recording apparatus whose size in the axial direction of a drum thereof is small.

An inkjet recording apparatus of the present invention includes: a drum, an inkjet head, a cap, a head-moving mechanism, and a cap-moving mechanism. The drum has a cylindrical outer circumferential surface, and rotates about a rotation axis thereof to convey a recording medium retained on the outer circumferential surface. The inkjet head has an ejection surface which extends in the axial direction and faces the outer circumferential surface, the ejection surface having a plurality of nozzles for ejecting ink droplets. The cap faces the outer circumferential surface. The head-moving mechanism moves the inkjet heads to any one of positions including a recording position, a wiping position, and a capping position, wherein the recording position is a position where inkjet head is disposed at a time of forming an image on a recording medium on the outer circumferential surface by ejecting ink droplets from the nozzles to the recording medium, the wiping position is a position in which the ejection surface of the inkjet head is farther distanced from the outer circumferential surface than in the recording position, and the capping position is a position in which the ejection surface of the inkjet head is farther distanced from the outer circumferential surface than in the recording position. The cap-moving mechanism moves the cap to an open position or an opposing position in the circumferential direction of the drum along the outer circumferential surface, wherein the open position is a position where the cap does not face the ejection surface, and the opposing position is a position where the cap faces the ejection surface and covers the inkjet head while the inkjet head is in the capping position.

With the present invention, the cap facing the outer circumferential surface of the drum moves in the circumferential direction along the outer circumferential surface of the drum. The cap therefore does not protrude from the position of the drum in the axial direction, whether the cap is in the open position or in the opposing position. Therefore, downsizing of the inkjet recording apparatus in the axial direction of the drum is possible.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
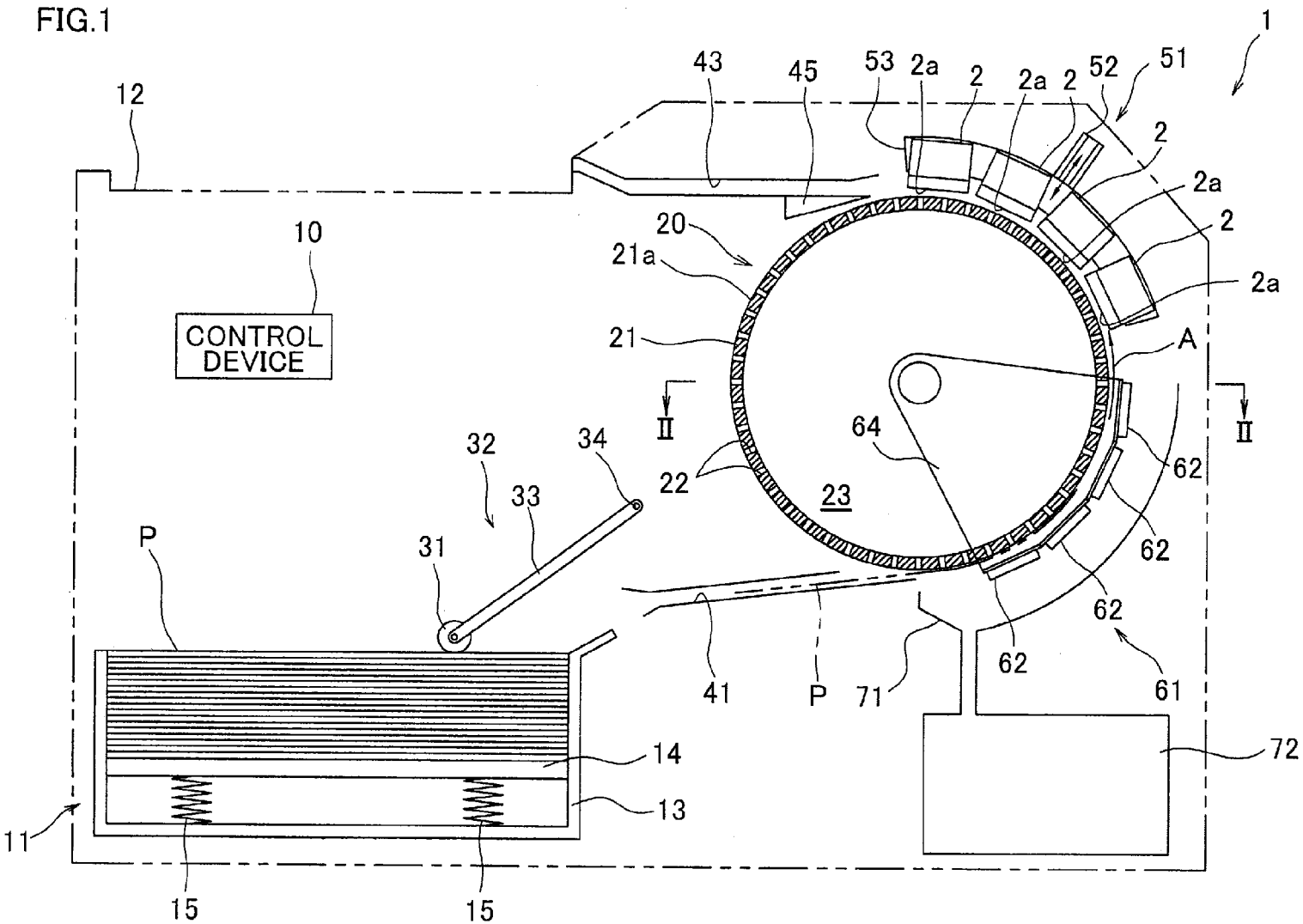
FIG. 1 is a side view illustrating an embodiment of an inkjet printer according to the present invention.

The following describes, with reference to FIG. 1, an embodiment of inkjet printer according to the present invention. An inkjet printer 1 which is an inkjet recording apparatus is a color inkjet printer, and includes: a sheet conveyance mechanism 20, four inkjet heads 2, a head-moving mechanism 51, a cap unit 61 including four caps 62, four wipers 66 (see FIG. 5), a cap moving mechanism, a wiper moving mechanism, and a control device 10. The sheet conveyance mechanism 20 includes a drum 21 having a cylindrical outer circumferential surface 21*a*. The control device 10 serves as a control means which controls operations of the above mentioned members. Note that illustration of the wipers 66 are omitted in FIG. 1 as a matter of convenience. In the lower part of the inkjet printer 1 is provided a sheet-feeding tray 11. On the top surface of the casing is provided a sheet receiving tray 12. Further, in the inkjet printer 1, a sheet conveyance path is formed. This sheet conveyance path extends from the sheet-feeding tray 11 to the lower end of the drum 21, and from the lower end of the drum 21 to the sheet receiving tray 12 via the upper end of the drum 21 along the outer circumferential surface 21 of the drum 21.

Each of the four inkjet heads 2 has ink passages having nozzles for ejecting ink droplets, and is formed in a parallelepiped shape elongated in the axial direction of the drum 21. From each of these inkjet heads 2 is ejected ink of one of the following four colors: magenta, yellow, cyan, and black. These four inkjet heads 2 are aligned in the circumferential direction of the drum 21 along the outer circumferential surface thereof. In short, the inkjet printer 1 is a line printer.

The lower surface of each of the inkjet head 2 serves as an ejection surface 2*a* having thereon nozzle openings. This ejection surface 2*a* of the inkjet head 2 faces the outer circumferential surface 21*a*.

The sheet-feeding tray 11 has a tray main body 13 opened in the upper direction. In the tray main body 13 is stored a stack of sheets P. Inside the tray main body 13 are arranged a plate 14 which supports the sheets P from the bottom, and two springs 15 which urges the plate 14 upward. The plate 14 is formed in a plane shape which is substantially the same as the tray main body 13, and is disposed in such a manner that the plate 14 is able to move upward or downward within the tray main body 13.

Further, the inkjet printer 1 includes a pickup roller 31 and a pickup roller moving mechanism 32 which rotates the pickup roller 31. The pickup roller 31, while being rotated, contacts a sheet P at the top of the stack of sheets P so as to feed out the sheet P to the drum 21.

The pickup roller moving mechanism 32 includes a turning arm 33, a shaft 34, and a not-illustrated drive motor. A lower end of the turning arm 33 rotatably supports the pickup roller 31, and an upper end of the same is fixed to the shaft 34. The drive motor rotates the shaft 34 to rotate the turning arm 33 about the shaft 34. With this pickup roller moving mechanism 32, the turning arm 33 is moved so that the pickup roller 31 is positioned in one of the following two positions: a contact position where the pickup roller 31 contacts the uppermost sheet P in the tray main body 13; and a separation position where the pickup roller 31 is apart from the uppermost sheet P in the tray main body 13. While the pickup roller 31 is in the separation position, the sheet-feeding tray 11 is easily attached or detached. Note that aforementioned springs 15 are structured in such a manner that a friction within a predetermined range is generated between the pickup roller 31 and the uppermost sheet P, irrespective of the number of sheets P stored in the tray main body 13. This prevents a problem in feeding out a sheet P by the pickup roller 31.

Further, as a part of a sheet conveyance path, the inkjet printer 1 includes an introduction path 41 through which a sheet P sent out from the sheet-feeding tray 11 by the pickup roller 31 is lead to the outer circumferential surface 21*a* of the drum 21, which surface adsorbs and retains thereon the sheet P. The introduction path 41 is a substantially straight path which extends from the sheet-feeding tray 11 to the lower end of the drum 21.

Figure 2:
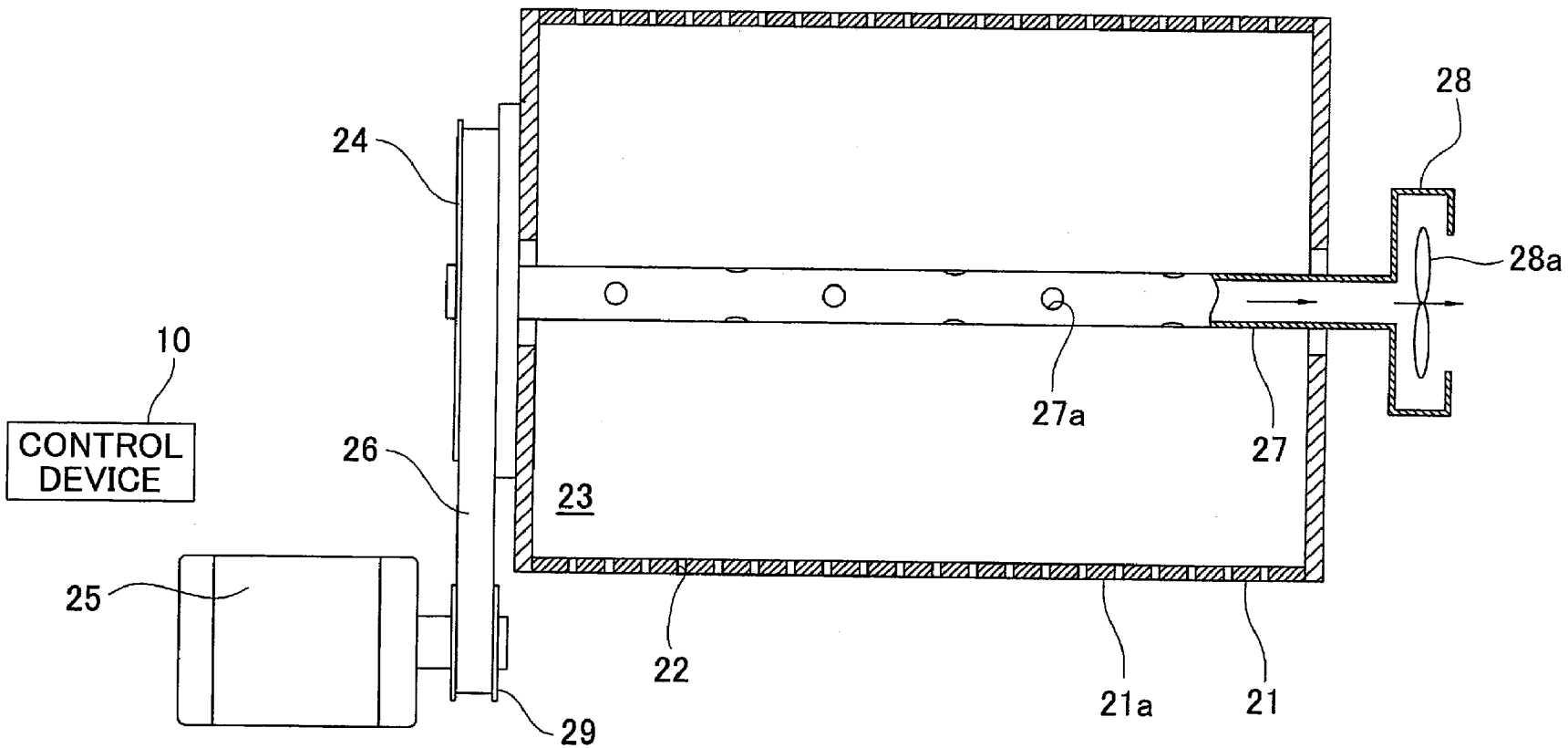
FIG. 2 is a cross sectional view taken along the line II-II of FIG. 1.

The drum 21 is further detailed with reference to FIG. 2. The drum 21 has a pipe-like shape and the axial direction thereof conforms with a direction perpendicular to the surface of the FIG. 1. The both ends of the drum 21 is closed. The centers of the both closed ends of the drum 21 are connected with each other via a tubular shaft 27 extending in the axial direction and penetrating the both ends. The tubular shaft 27 rotates with the drum 21.

The outer circumferential surface 21*a* is formed on a circumferential wall of the drum 21. This circumferential wall has through holes 22 communicating an internal space 23 of the drum 21 with the outside of the drum. These through holes 22 are all uniformly formed. Further, the circumferential wall of the tubular shaft 27 in the internal space 23 has through holes 27*a* communicating the inside of the tubular shaft 27 with the internal space 23. These through holes 27*a* are uniformly formed. The left end of the tubular shaft 27 is sealed, and the right end of the same is connected to an air-suction device 28 having a fan 28*a*. Driving of the air-suction device 28 aspirates the air in the internal space 23 into the tubular shaft 27 via the through holes 27*a*, and from the tubular shaft 27 to the outside the drum 21. Thus, an air flow from the outside of the drum 21 to the internal space 23 via the through holes 22 is created. This enables the outer circumferential surface 21*a* of the drum 21 to adsorb thereon a sheet P.

On the left end of the tubular shaft 27 is supported a pulley 24 which rotates along with the tubular shaft 27. Further, a belt 26 is looped around the pulley 24 and a pulley 29 attached to the rotational shaft of a conveyance motor 25. The conveyance motor 25 rotates the tubular shaft 27 and the drum 21 counterclockwise in FIG. 1, via the belt 26 and the pulleys 24 and 29, thereby conveying a sheet adsorbed and retained on the outer circumferential surface 21*a* in a conveyance direction A indicated by the arrow; that is, in the circumferential direction of the drum 21, along the outer circumferential surface 21*a* of the drum 21.

In the present embodiment, the conveyance motor 25, belt 26, tubular shaft 27, pulleys 24 and 29, or the like form a drum drive device. This drum drive device, drum 21, and the air-suction device 28 form the sheet-conveyance mechanism 20. Driving the air-suction device adsorbs and retains on the outer circumferential surface 21*a* a sheet P having conveyed through the introduction path 41 from the sheet-feeding tray 11. Then, as the drum drive device drives the drum 21 to rotate the same in the counter clockwise direction, the sheet P is conveyed in the conveyance direction A. Then, the inkjet heads 2 eject ink of different colors to the sheet P conveyed on the drum 21, while the respective ejection surfaces 2*a* of the inkjet heads 2 face the sheet P. Thus, an intended colored image is printed on the sheet P.

Towards the downstream of the drum 21 in the conveyance direction A is provided a separator 45. The separator 45 separates a sheet P from the outer circumferential surface 21*a* of the drum 21 retaining the sheet P so as to feed the sheet P to an output path 43 which is also a part of the sheet conveyance path.

The head-moving mechanism 51 moves the four inkjet heads 2 simultaneously so that relative positions of the four inkjet heads do not change. The head-moving mechanism 51 has a guide rail 52, and a head frame 53 supporting the four heads. The guide rail 52 retains the four inkjet heads 2 so that the inkjet heads 2 are positioned symmetrically with respect to the center of these heads 2 along the circumferential direction of the drum 21. Further, the guide rail 52 supports the head frame 53 so as to enable the head 53 to slide along the radial direction. A line extended in the sliding direction of the head frame 53 is perpendicular to the outer circumferential surface 21*a*. In other words, the center of the head frame 53 in the circumferential direction slides along the guide rail 52 to move along the line which extends through the center of the guide rail and which is perpendicular to the outer circumferential surface 21*a* of the drum 21.

The control device 10 controls a not-illustrated actuator to move the head frame 53 along the guide rail 52, thereby determining the positions of the four inkjet heads 2, which are fixed on the head frame 53, relative to the outer circumferential surface 21*a*. Specifically, the head-moving mechanism 51 positions the four inkjet heads 2 so that the inkjet heads 2 are in any one of the following positions: a printing position (see FIG. 1), a capping position (See FIG. 4), a wiping position (See FIG. 6), and a retracted position (See FIG. 7). The printing position is a position where the inkjet heads 2 are disposed at a time of performing printing to a sheet P by ejecting ink droplets from the ejection surfaces 2*a*. The capping position is a position in which each ejection surface 2*a* and one of the caps 62 facing the ejection surface 2*a* form a sealed space having the ejection surface 2*a* as an inner wall surface. The wiping position is a position in which each ejection surface 2*a* contacts a portion nearby the leading end of a wiper 66 (see FIG. 5) facing the ejection surface 2*a*. The retracted position is a position in which each ejection surface 2*a* is separated from the leading end of the wiper 66 facing the ejection surface 2*a*.

The distance between the outer circumferential surface 21*a* of the drum 21 and the ejection surface of each of the four inkjet heads 2 is hereinafter referred to as a separation distance. The separation distance of each of the inkjet heads 2 in the above mentioned positions is expressed as follows: the separation distance of the inkjet head 2 in the printing position<the separation distance of the inkjet head 2 in the capping position<the separation distance of the inkjet head 2 in the wiping position<the separation distance of the inkjet head 2 in the retracted position. Each of the four inkjet heads 2 is disposed so that, while the inkjet head 2 is in the printing position, the normal to the center of the ejection surface 2*a* is perpendicular to the outer circumferential surface 21*a*. Note however that the normal to the center of the ejection surface 2*a* of each of the inkjet heads 2 does not conform with the moving direction of the inkjet head 2. As such, the normal to the center of the ejection surface 2*a* is not perpendicular to the outer circumferential surface 21*a* while the inkjet head 2 is in a position other than the printing position.

Figure 3:
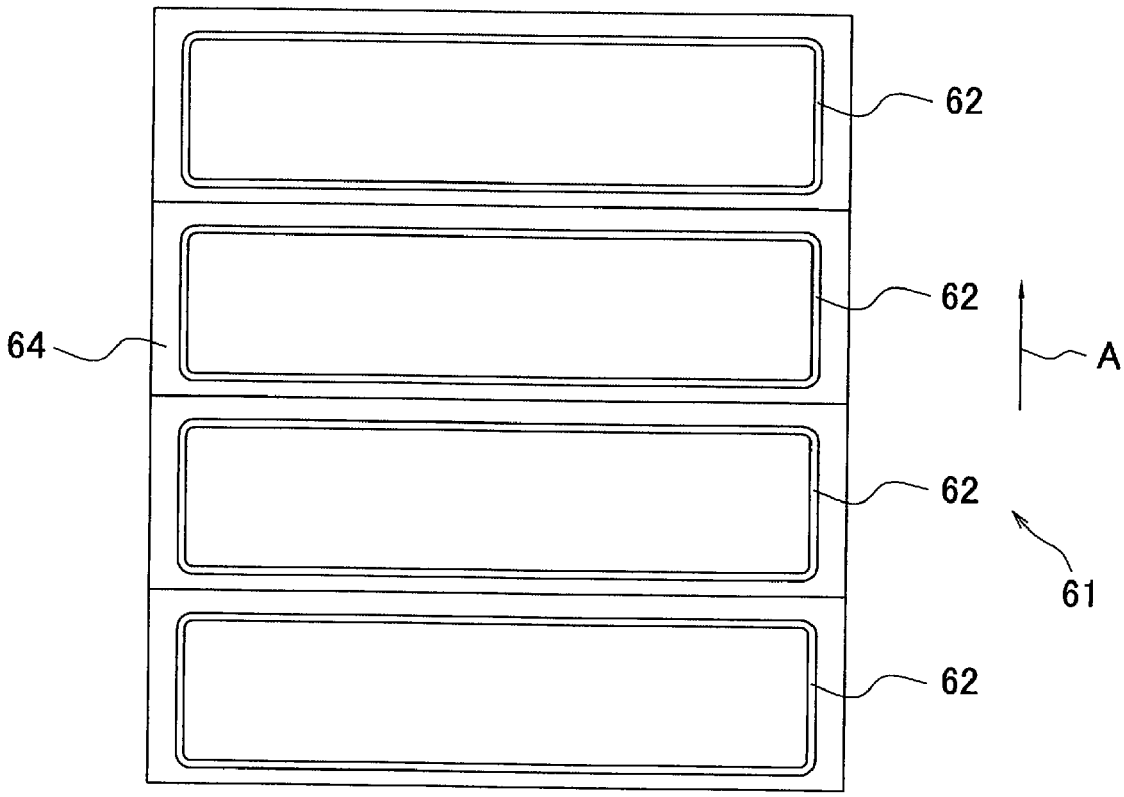
FIG. 3 is a development view of a cap unit of FIG. 1 developed on a plane.

Next, a capping unit 61 is described with reference to FIG. 3 and FIG. 4. The cap unit 61 is used when performing a maintenance of the ejection surfaces 2*a* of the inkjet heads 2, and includes: four caps 62 aligned in the conveyance direction A of the sheet P, a cap tray 64 supporting the caps 62, a waste liquid tray 71, and a waste liquid tank 72.

Each of the caps 62 is made of an elastic material such as an ink-resistance rubber or resin. The caps 62 each has an annular projection having a substantially rectangular plane shape, which projection defines a recessed portion whose bottom surface is the cap tray 64. The recessed portion defined by the annular projection extends in the axial direction of the drum 21 in a plane view. The size of the recessed portion is smaller than the ejection surface 2*a*, but is sufficient for including the entire region of the ejection surface 2*a* where the nozzle openings are provided.

The cap tray 64 is formed substantially in the shape of sector, and includes a curved part and a plane part connected to the curved part. The curved part faces the outer circumferential surface 21*a* of the drum 21, and is curved along the outer circumferential surface 21*a* of the drum 21. The plane part faces an end surface of the drum 21, and is capable of swinging about the rotational axis of the drum 21 so as to move the curved part in the circumferential direction of the outer circumferential surface 21*a* of the drum 21. The cap tray 64 is swung by a not-illustrated maintenance motor controlled by the control device 10. Note that lines hidden by the cap tray 64 in FIG. 1 are solid lines, though these lines should be dotted-lines. The outer surface of the curved part of the cap tray 64 holds the four caps 62, in such a manner that the caps 62 are positioned on the surface in the conveyance direction A of the sheet P. Note that the caps 62 correspond to the inkjet heads 2 on one-to-one basis.

Figure 4:
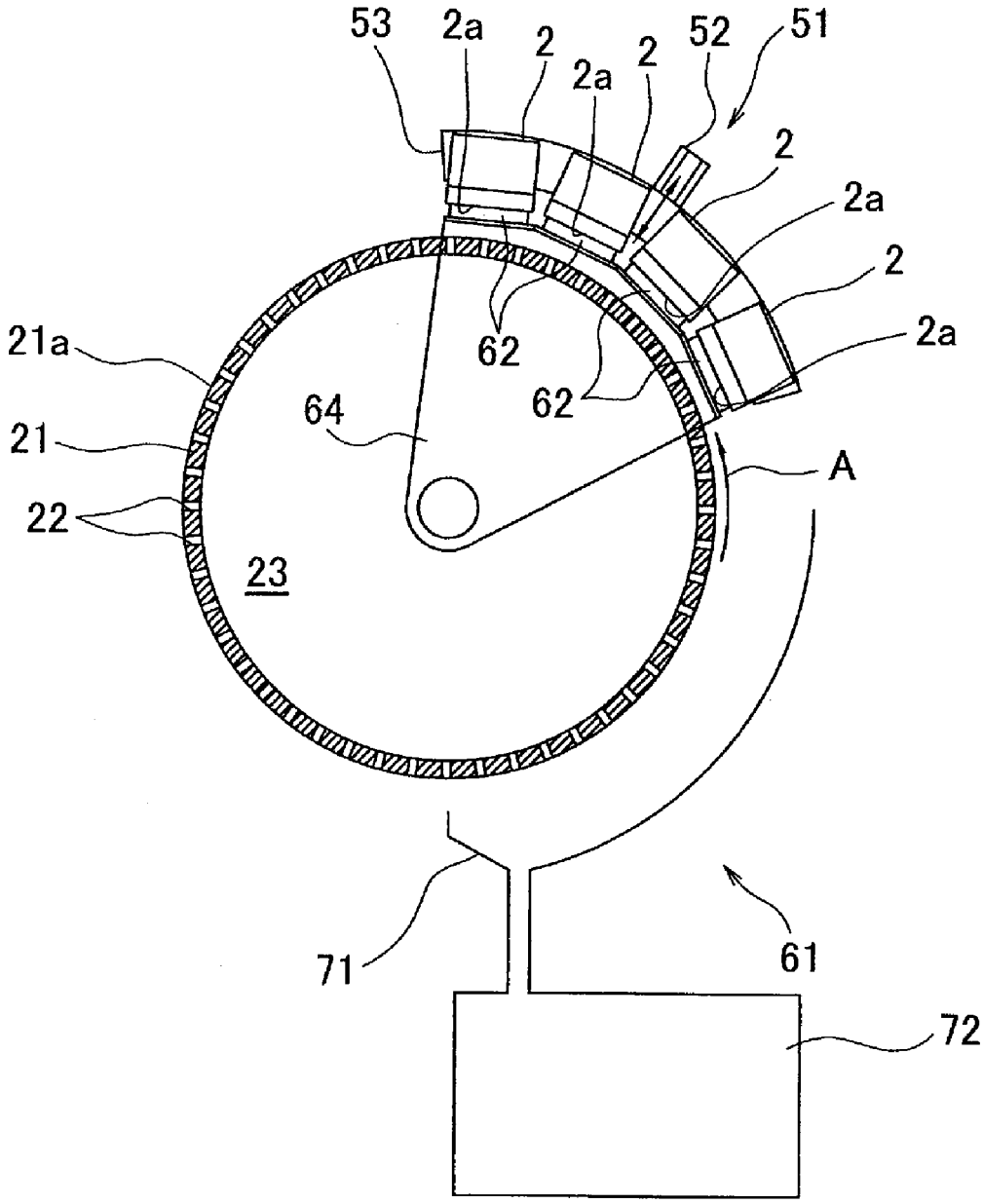
FIG. 4 is a side view illustrating an operation of the capping unit of the inkjet printer illustrated in FIG. 1.

The control device 10 controls the angular orientation of the cap tray 64 so as to move the four caps 62 between the open position (standby position) illustrated in FIG. 1 and the opposing position illustrated in FIG. 4, in the circumferential direction along the outer circumferential surface 21*a* of the drum 21. The open position is a position which is upstream from the four inkjet heads 2 in the conveyance direction A, and is a position where the cap tray 64 faces none of the ejection surfaces 2*a*. In other words, the standby position is a position where the cap tray 64 does not face an area including the four ejection surfaces 2*a*. The opposing position is a position where the cap tray 64 faces all the ejection surfaces 2*a*. While the caps 62 are in the opposing position, each of the caps 62 faces the corresponding ejection surface 2*a* of the corresponding inkjet head 2. Further, while the caps 62 are in the open position, the openings of the recessed portions of all the caps 62 are faced downward. Thus, waste ink stored in the caps 62 from the caps 62 due to its own weight. In the present embodiment, the cap tray 64 and the maintenance motor or the like form a cap-moving mechanism.

While the caps 62 are in the opposing position, the inkjet heads 2 move from the retracted position or the wiping position to the capping position, and the ejection surface 2*a* of each of the inkjet heads 2 closely touches the annular projection of corresponding one of the caps 62, thus creating a sealed space having the ejection surface 2*a* as an inner wall surface. This restrains drying and thickening of the ink inside the nozzles. Further, through a purging operation for discharging thickened ink inside the nozzles, the ink ejected from the ejection surface 2*a* is received inside the cap 62 while avoiding dispersion of ink droplets outside the cap 62.

The waste liquid tray 71 is positioned so as to be located below the caps 62 while the caps 62 are in the open position. This waste liquid tray 71 leads, to the waste liquid tank 72, the waste ink discharged from the caps 62 in the open position. The waste liquid tank 72 is positioned below the waste liquid tray 71, and stores therein the waste ink having lead by the waste liquid tray 71.

Figure 5:
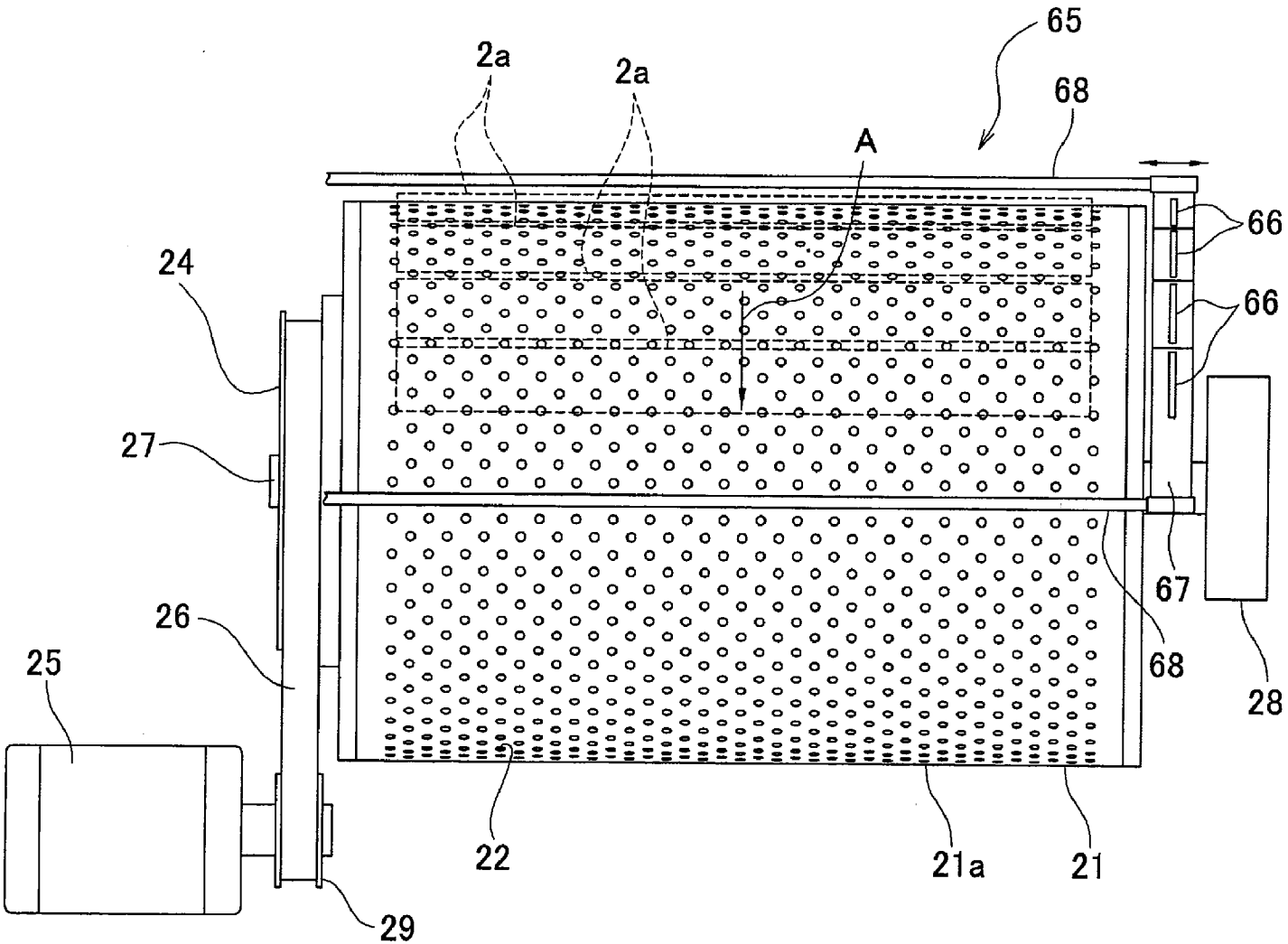
FIG. 5 is a plane view of the inkjet printer illustrated in FIG. 1.

Next, the wiper-moving mechanism 65 is further detailed with reference to FIG. 5 to FIG. 7. Note that the ejection surfaces 2*a* of the inkjet heads 2 in the wiping position are indicated by dotted lines in FIG. 5. As illustrated in the figures, the wiper-moving mechanism 65 includes: a wiper tray 67 supporting the four wipers 66 aligned in the conveyance direction of the sheet P; a pair of wipe-guides 68 which are parallel to each other; and a not-illustrated actuator.

The pair of wipe-guides 68 extend parallel to the rotational axis of the drum 21. The both of the wipe-guides 68 are distanced from the outer circumferential surface 21 by the same distance. One of the wipe-guides 68 is slightly upstream from the separator 45, and the other wipe-guide 68 is slightly upstream from one of the inkjet heads 2 disposed uppermost stream relative to the conveyance direction A. These wipe-guides 68 respectively support both ends of the wiper tray 67 in the conveyance direction A so that the wiper tray 67 made of a thin and hard plate having a small width (length in the axial direction) is able to slide in the axial direction of the drum. The wiper tray 67 is inflected at three positions so as to form a shape that extends along the outer circumferential surface 21*a*, consequently forming outer planes respectively facing the four ejection surfaces 2*a* on the wiper tray 67.

The wiper tray 67 is moved in the axial direction of the drum by the actuator controlled by the control device 10. The wiper tray 67 is moveable between two positions (wiping start position and wiping end position) sandwiching the ejection surfaces 2*a*.

The wiper tray 67 preferably does not protrude from the drum 21 in the axial direction. However, an increase in the size of the printer 1 in the axial direction is prevented, as long as the length of the wiper tray 67 in the axial direction is sufficiently small. In a structure where the wiper tray 67 protrude from the drum 21 in the axial direction, it is preferable that the wiper tray 67 be moveable within a range from a position between the air-suction device 28 and the drum 21 to a position between the drum 21 and the pulley 24 or the motor 25, as illustrated in FIG. 5.

Each of the four wipers 66 is a blade for wiping the ejection surface 2*a*, and is made of an elastic material such as an ink-resistant rubber or resin. The wipers 66 have the same size, and are all thinner than the wiper tray 67. Further, each of the wipers 66 is fixed perpendicularly to the outer plane of the wiper tray 67, and extends in the width direction of the ejection surface 2*a*. The leading end of each of the wipers 66 is in a rectangular shape, and is parallel to the ejection surface 2*a* of the inkjet head 2. The height of each of the wiper 66 is slightly larger than the separation distance of the inkjet head 2 in the wiping position. Thus, when the wiper 66 moves in the axial direction to face the ejection surface 2*a*, the wiper 66 is able to wipe the ejection surface 2*a*.

Figure 6:
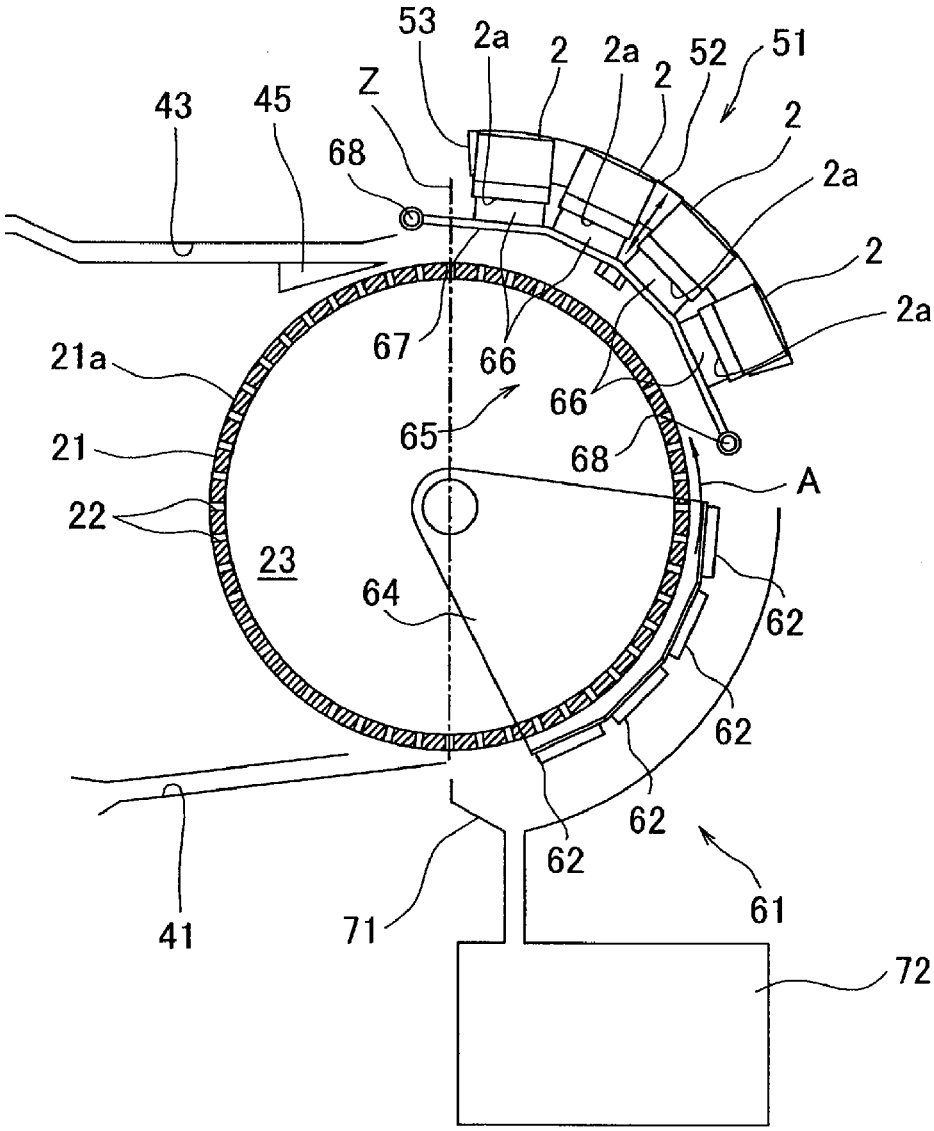
FIG. 6 and FIG. 7 are side views of the inkjet printer illustrated in FIG. 5.

The wiper tray 67 is entirely slanted downwards so that an angle between the outer planes and the horizontal plane increases towards the right of FIG. 6. Thus, among the four wipers 66, a wiper 66 on the left of FIG. 6 is positioned higher than a wiper 66 on the right of the figure. Further, the lower end (right end of FIG. 6) of the wiper tray 67 is positioned above the waste liquid tray 71. With this, ink adhered to the wiper tray 67 is more likely to flow down into the waste liquid tray 71.

In the present embodiment, the wipers 66 move from the wiping start position (e.g. the position shown in FIG. 5) in the axial direction, after the inkjet heads 2 move to the wiping position shown in FIG. 8. At this point, each of the wipers 66 moves in the axial direction of the drum 21 while contacting the corresponding ejection surface 2*a*, thus wiping the ejection surface 2*a* and shaping the meniscus. Ink adhered to the wipers 66 then flows down along the wiper tray 57, and then flows into the waste liquid tank 72 via the waste liquid tray 71 located below the wiper tray 67. The ink is stored in the waste liquid tank 72. The wiping of the ejection surface 2*a* is completed when the wipers 66 reach the wiping end position which is on the opposite side of the wiping start position across the ejection surfaces 2*a* in the axial direction. After that, the inkjet heads 2 move to the retracted position shown in FIG. 7, and the wipers 66 move back from the wiping end position to the wiping start position. At this point, the inkjet heads 2 are in the retracted position, the wipers 66 do not contact the ejection surfaces 2*a*, and the meniscus formed on each of the nozzle openings therefore are not damaged. This series of operations for wiping the ejection surfaces 2*a* is hereinafter referred to as wiping operation.

Next, the following describes an operation which takes place at a time of performing printing to the sheet P. It is supposed that the inkjet heads 2 are brought to the printing position prior to the printing. First, a sheet P is fed to the drum 21 from the sheet-feeding tray 11. In this step, the uppermost sheet P among a stack of sheets P stored in the sheet-feeding tray 11 contacts the pickup roller 31. The pickup roller 31 rotates counter clockwise while being in contact with the sheet P, thereby feeding the sheet P to the introduction path 41. The sheet P fed out is then lead through the introduction path 41, and arrives at the drum 21.

At the same time, the drive mechanism drives the drum 21 to rotate the drum 21 in the conveyance direction A, and the air-suction device 28 is driven to adsorb and retain the sheet P on the outer circumferential surface 21*a* of the drum 21. The sheet P retained on the outer circumferential surface 21*a* of the drum 21 is then conveyed in the conveyance direction A with the rotation of the drum 21.

When the sheet P reaches a position so as to face the ejection surface 2*a*, the ejection surfaces 2*a* of the four inkjet heads 2 eject ink from their nozzles to form an image on the sheet P. Then, the sheet P on which the image is formed is separated from the outer circumferential surface 21*a* of the drum 21 by the separator 45, and is fed out to the output path 43. The sheet P fed to the output path 43 is conveyed towards the sheet receiving tray 12, and is received by the sheet receiving tray 12.

Next, the following details a maintenance operation of the inkjet heads 2. The maintenance operation of the inkjet heads 2 includes a capping operation, a purge operation, and the wiping operation. The capping operation is an operation in which each of the caps 62 creates a sealed off space having the corresponding ejection surface 2*a* as an inner wall. The purge operation is an operation in which thickened ink inside the nozzles opened on the ejection surfaces is discharged into the caps 62. Further, in the wiping operation, meniscus formed on each of the nozzle openings is shaped, as hereinabove mentioned. The maintenance operation is performed at a time of powering on the inkjet printer 1, or immediately before the printing to a sheet P.

FIG. 1 illustrates an ordinary state where printing to the sheet P is possible. During this state, the inkjet heads 2 are in the printing position, the caps 62 are in the open position, and the wipers 66 are in the wiping start position. When the maintenance operation starts during this state illustrated in FIG. 1, the inkjet heads 2 first move from the printing position to the retracted position. Then, the caps 62 move from the open position to the opposing position. Thus, each of the caps 62 faces corresponding one of the ejection surfaces 2*a*. Then, the inkjet heads 2 move from the retracted position to the capping position and each of the ejection surfaces 2*a* is closely attached to the annular projection of the corresponding cap 62, thereby creating a sealed space having the ejection surface as an inner wall. The capping operation is then ended. When the capping operation ends, the purging operation for discharging the thickened ink inside each nozzle is performed. The purging operation is performed by driving a not-illustrated pump connected to the ink supply path of the inkjet head 2. At this point the ink droplets ejected from the ejection surface 2*a* is received in the cap 62.

When the purge operation is ended, the inkjet heads 2 move from the capping position to the wiping position illustrated in FIG. 6. Then the caps 62 move to the open position. Then, waste ink in the caps 62 in the open position is discharged therefrom to the waste liquid tray 71. The discharged waste ink is then lead to the waste liquid tank 72 through the waste liquid tray 71. During this state the wipers 66 move from the wiping start position to the wiping end position so as to wipe the ejection surfaces 2*a*. At this point, the four wipers 66 each wipes different one of the ejection surfaces 2*a*. Thus, meniscus to be formed at each of the nozzle openings is shaped. Further, the ink adhered to the wiper 66 flows down along the wiper tray 67, and flows into the waste liquid tray 71 located below the wiper tray 71. Thus, the ink is stored in the waste liquid tank 72.

Figure 7:
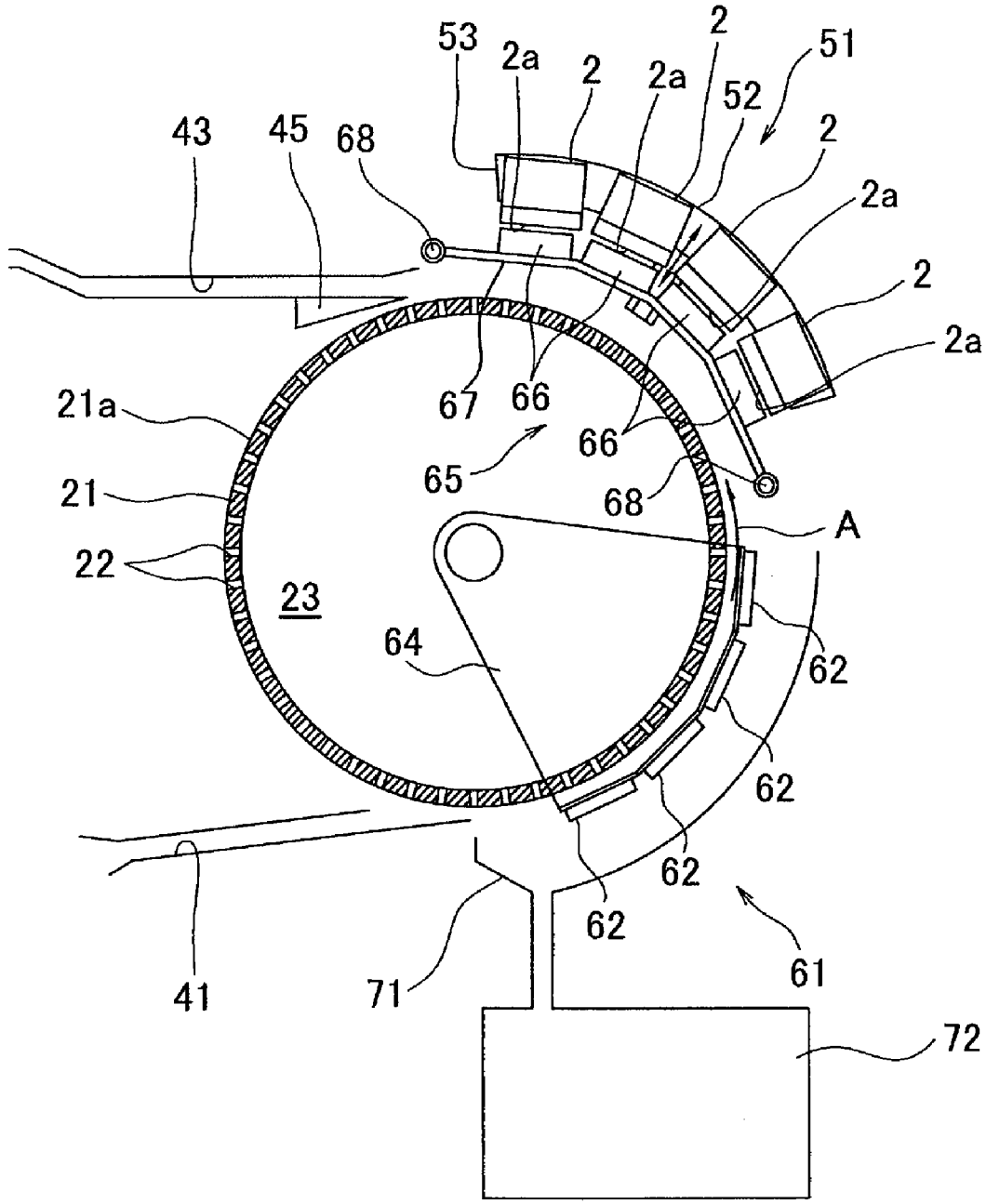

After that, the inkjet heads 2 move to the retracted position as illustrated in FIG. 7. Further, the wipers 66 move to the wiping start position and the wiping operation is completed. Thus, the maintenance operation of the inkjet heads 2 is completed.

Each of the caps 62 forms a sealed off space having the ejection surface 2*a* as an inner wall, except for occasions of performing printing and maintenance operation. This restrains drying and thickening of the ink inside the nozzles.

According to the present embodiment as hereinabove described, each of the caps 62 facing the circumferential surface 21*a* of the drum 21 moves in the circumferential direction along the outer circumferential surface 21*a* of the drum 21. The cap 62 therefore does not protrude from the drum 21 in the axial direction whether it is in the open position or in the opposing position. Thus, downsizing of the printer 1 in the axial direction is possible.

Further, the wiper 68 wipes the corresponding ejection surface 2*a* in the axial direction of the drum 21. This allows the wiper 66 to evenly wipe the ejection surface 2*a*, while preventing the ejection surface 2*a* from being contaminated by the different ink.

Further, in the capping operation, each of the caps 62 form a sealed space having the corresponding one of the ejection surfaces 2*a* as an inner wall, and each of the wipers 66 wipes different one of the ejection surfaces 2*a*. This prevents the contamination by the different ink without fail.

Further, ink adhered to each of the wipers 66 flows down along the wiper tray 67, flows into the waste liquid tank 72 via the waste liquid tray 71 located below the wiper tray 67, and is stored in the waste liquid tank 72. The waste ink therefore is efficiently collected.

Further, the four inkjet heads 2 move simultaneously, and the relative positions thereof do not change. Therefore, the structure of the head-moving mechanism 51 is made simple.

In addition, the inkjet heads 2 are moveable to the retracted position by means of the head-moving mechanism 51. Thus, when no wiping operation is needed, the wipers 66 are able to move while avoiding contacting the ejection surfaces 2*a* when the wiping operation is not needed. This restrains damage to meniscus formed on each nozzle opening.

The above-mentioned embodiment deals with a case where the inkjet printer 1 has four inkjet heads 2. However, the number of the inkjet heads 2 may be any given number. For example, the number of the inkjet heads 2 may be one to three or, five or more.

Further, the above embodiment allows the inkjet heads 2 to be moved to the retracted position. However, a structure which does not move the inkjet heads 2 to the retracted position is also possible. In such a case, the inkjet heads 2 are moved to the wiping position, instead of the retracted position. Note, however, that the ejection surfaces 2*a* are wiped even when the wiping operation is not necessary.

Further, the above embodiment deals with a case where the caps 62 receive the ejected ink droplets in the purging operation. However, while keeping these caps in the same structure, it is possible to provide a purge area capable of retaining ink to a predetermined position of the outer circumferential surface 21 of the drum 21, and to eject ink droplets to the purge area during the purging operation. This allows omission of the process of forming with the cap 62 a sealed space having the ejection surface 2*a* as an inner-wall surface, in the purging operation. As a result, the maintenance operation is promptly completed.

Further, the above-mentioned embodiment deals with a case where the wipers 66 do not move in the circumferential direction of the drum 21. It is however possible to adopt a structure in which the wipers 66 move in the circumferential direction along the outer circumferential surface 21*a* of the drum 21 so that the wiper tray 67 faces the waste liquid tray 71 and the drum 21 in the radial direction of the drum 21. With this structure, the ink adhered to the wiper tray 67 more efficiently flows down into the waste liquid tray 71. Note that the structure may be further adapted so that the wiping operation is performed while the wipers 66 move in the circumferential direction.

Further, the above embodiment deals with a case where a sheet P is held on the outer circumferential surface of the drum 21 by means of the air-suction device. However, the outer circumferential surface of the drum 21 may posses adhesiveness. This simplifies the structure of the device.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An inkjet recording apparatus, comprising:

a drum having a cylindrical outer circumferential surface, which rotates about a rotation axis thereof to convey a recording medium retained on the outer circumferential surface;

a plurality of inkjet heads which respectively eject different colors of ink, each having an ejection surface which extends in the axial direction and faces the outer circumferential surface, each ejection surface having a plurality of nozzles for ejecting ink droplets;

a plurality of caps each of which covers the ejection surface of different one of the plurality of the inkjet heads, each facing the outer circumferential surface;

a head-moving mechanism which moves the inkjet heads to any one of positions including a recording position, a wiping position, and a capping position;

a cap-moving mechanism which moves the plurality of caps to an open position or an opposing position in the circumferential direction of the drum along the outer circumferential surface;

a plurality of wipers each of which wipes a different one of the ejection surfaces of the plurality of inkjet heads and each extending in a width direction of the ejection surfaces;

a wiper-moving mechanism which moves the plurality of wipers in the axial direction along the outer circumferential surface so as to wipe the ejection surfaces of the plurality of inkjet heads in the wiping position;

a waste liquid tray which receives wasted ink, and which is disposed below the lower most one of the plurality of wipers; and a wiper tray which supports the plurality of wipers, wherein the wiper tray is slanted downward, and a lower end thereof is positioned above the waste liquid tray, wherein the plurality of the inkjet heads, the plurality of the wipers, and the plurality of the caps are aligned in the circumferential direction along the outer circumferential surface, and wherein the recording position is a position where the plurality of inkjet heads are disposed at a time of forming an image on a recording medium on the outer circumferential surface by ejecting ink droplets from the nozzles to the recording medium, the wiping position is a position in which the ejection surfaces of the plurality of inkjet heads are farther distanced from the outer circumferential surface than in the recording position, and the capping position is a position in which the ejection surfaces of the plurality of inkjet heads are farther distanced from the outer circumferential surface than in the recording position, wherein the open position is a position where the plurality of caps do not face the ejection surfaces, and the opposing position is a position where the plurality of caps face the ejection surfaces and cover the plurality of inkjet heads while the plurality of inkjet heads are in the capping position.

2. The apparatus according to claim 1, wherein the head-moving mechanism simultaneously moves the inkjet heads without changing relative positions of the plurality of the inkjet heads.

3. The apparatus according to claim 1, wherein the head-moving mechanism is capable of moving the inkjet head to a retracted position so that the ejection surface of the inkjet head while the inkjet head is in the retracted position is farther distanced from the outer circumferential surface than in the wiping position, and that the wiper is apart from the inkjet head when the wiper moved by the wiper-moving mechanism is in a position to face the ejection surface of the inkjet head.

* * * * *